US007051795B2

(12) United States Patent
Kamiyama et al.

(10) Patent No.: US 7,051,795 B2
(45) Date of Patent: May 30, 2006

(54) MULTI-FUNCTION HEAT EXCHANGER

(75) Inventors: Naohisa Kamiyama, Ashikaga (JP); Toshiharu Watanabe, Sano (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/846,384

(22) Filed: May 14, 2004

(65) Prior Publication Data

US 2005/0006069 A1 Jan. 13, 2005

(30) Foreign Application Priority Data

May 14, 2003 (JP) ..... P2003-135894

(51) Int. Cl.
*F28D 1/04* (2006.01)

(52) U.S. Cl. ..... 165/140; 165/153

(58) Field of Classification Search ..... 165/140, 165/144, 151–153, 174, 176
See application file for complete search history.

(56) References Cited

U.S. PATENT DOCUMENTS

| | | | | |
|---|---|---|---|---|
| 5,186,243 | A * | 2/1993 | Halstead | 165/135 |
| 6,394,176 | B1 * | 5/2002 | Marsais | 165/140 |
| 6,883,600 | B1 * | 4/2005 | Mano et al. | 165/174 |
| 2002/0040776 | A1 * | 4/2002 | Kokubunji et al. | 165/140 |

FOREIGN PATENT DOCUMENTS

JP 2000-018880 1/2000

* cited by examiner

*Primary Examiner*—Teresa J. Walberg
(74) *Attorney, Agent, or Firm*—Kilpatrick Stockton LLP

(57) ABSTRACT

A multi-function heat exchanger is integrally provided with a plurality of heat exchanger sections, in which a difference in dimensional change caused by thermal expansion of the heat exchanger sections can efficiently be absorbed. In this multi-function heat exchanger, header pipes are divided by panel walls and a plurality of heat exchanging tubes are divided by a pseudo heat exchanging passage member into an oil cooler section and a capacitor section. A notch is formed in the header pipes between the panel walls.

5 Claims, 8 Drawing Sheets

MULTI-FUNCTION HEAT EXCHANGER

BACKGROUND OF THE INVENTION

The present invention relates to a multi-function heat exchanger which is integrally provided with a plurality of mutually independent heat exchanger sections such as a capacitor section and an oil cooler section.

Normally, provided in an automobile are various heat exchangers such as a radiator for cooling engine, a capacitor for air conditioning, an oil cooler (ATF cooler) for cooling automatic transmission oil, and an oil cooler for cooling engine oil. The radiator and the capacitor are usually independently disposed in a front portion in an engine room, but in recent years, a multi-function heat exchanger which is integrally provided with the capacitor and the oil cooler has been developed to reduce an installation space and the number of assembling steps for reducing the heat exchanger in size.

In the multi-function heat exchanger, since a difference in temperature between a heat exchanging medium flowing through a capacitor section and oil flowing through an oil cooler section is great, a pseudo heat exchanging passage member through which a heat exchanging medium does not flow is provided between the capacitor section and the oil cooler section.

SUMMARY OF THE INVENTION

In the multi-function heat exchanger, however, since a header pipe of the capacitor section and a header pipe of the oil cooler section are separated from each other at a distance therebetween, the capacitor section and the oil cooler section are practically connected to each other through the pseudo heat exchanging passage member and a fin. Since both the sections are connected to each other through the thin fin, the connection strength between the capacitor section and the oil cooler section is not strong, and it is desired to enhance the connection strength so that the heat exchanger can endure stress caused by vibration and the like applied when the heat exchanger is transported or a vehicle runs.

The present invention provides a multi-function heat exchanger which is integrally provided with a plurality of heat exchanger sections, in which a difference in dimensional change caused by thermal expansion of the heat exchanger sections can efficiently be absorbed, and the connection strength between the capacitor section and the oil cooler section is enhanced.

According to a technical aspect of the present invention, there is provided a multi-function heat exchanger, comprising: a first core section having a plurality of first heat exchanging tubes through which first heat exchanging medium flows, and a first fin being mounted between the first heat exchanging tubes; a second core section having a plurality of second heat exchanging tubes through which second heat exchanging medium flows, and a second fin being mounted between the second heat exchanging tubes; a connecting member connecting the first core section and the second core section with each other;

a first header pipe being connected to one ends of the first heat exchanging tubes and one ends of the second heat exchanging tubes; a second header pipe being connected to the other ends of the first heat exchanging tubes and the other ends of the second heat exchanging tubes; a first heat exchanger section including a flow passage for the first heat exchanging medium which flows through the first header pipe, the first heat exchanging tube, and the second header pipe; a second heat exchanger section including a flow passage for the second heat exchanging medium which flows through the first header pipe, the second heat exchanging tube, and the second header pipe, and the flow passage being separated from the flowing paths of the first heat exchanging medium; and a notch formed between a side of the first header pipe being connected to the first heat exchanging tube and a side of the first header pipe being connected to the second heat exchanging tube, a portion of the notch being cut off in a radial direction of the first header pipe.

According to another technical aspect of the invention, the connecting member is separated from the first header pipe.

DESCRIPTION OF THE PREFERRED EMBODIMENTS

First Embodiment

Figure 1:
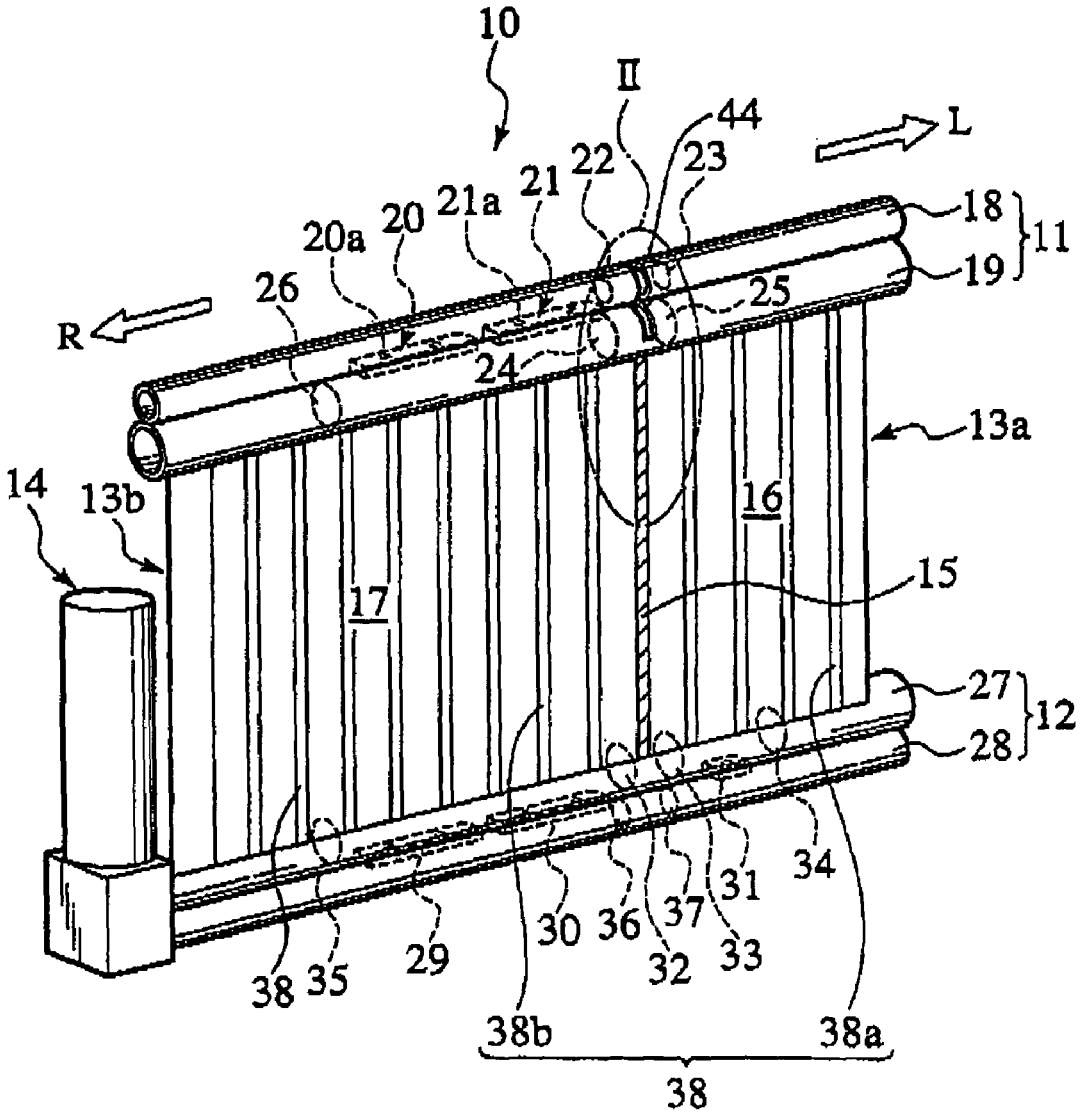
FIG. 1 is a perspective view showing a heat exchanger according to a first embodiment of the present invention.

FIG. 1 is a perspective view of a multi-function heat exchanger 10 according to a first embodiment of the present invention. As shown in FIG. 1, the heat exchanger 10 of this embodiment includes an upper header pipe 11 arranged in the upper portion, a lower header pipe 12 being arranged in the lower portion, core sections 13 that vertically connect the upper header pipe 11 and the lower header pipe 12 with each other, and a liquid tank 14 being connected to a side portion of the lower header pipe 12. To clearly show the configuration, a fin is omitted in FIG. 1. As will be described later, a left side (L-side in FIG. 1) from a pseudo heat exchanging passage member 15 is an oil cooler section 16 which is a first heat exchanger section, and a right side (R-side in FIG. 1) from the pseudo heat exchanging passage member 15 is a capacitor section 17 which is a second heat exchanger section. The capacitor section 17 cools a refrigerant for an air conditioning cycle and the oil cooler section 16 cools automatic transmission oil. The core sections 13 are a first core section 13*a* included in the oil cooler section and a second core section 13*b* included in the capacitor section which are separated from each other with respect to the pseudo heat exchanging passage member 15 as a connecting member.

The upper header pipe 11 includes an upper pipe 18 and a lower pipe 19 which are vertically adjacent to each other.

The upper pipe 18 and the lower pipe 19 are connected to each other through joint members 20 and 21 having a plurality of through holes 20*a* and 21*a*. The upper header pipe 11 is partially formed with a notch 44 in its radial direction.

Figure 2:
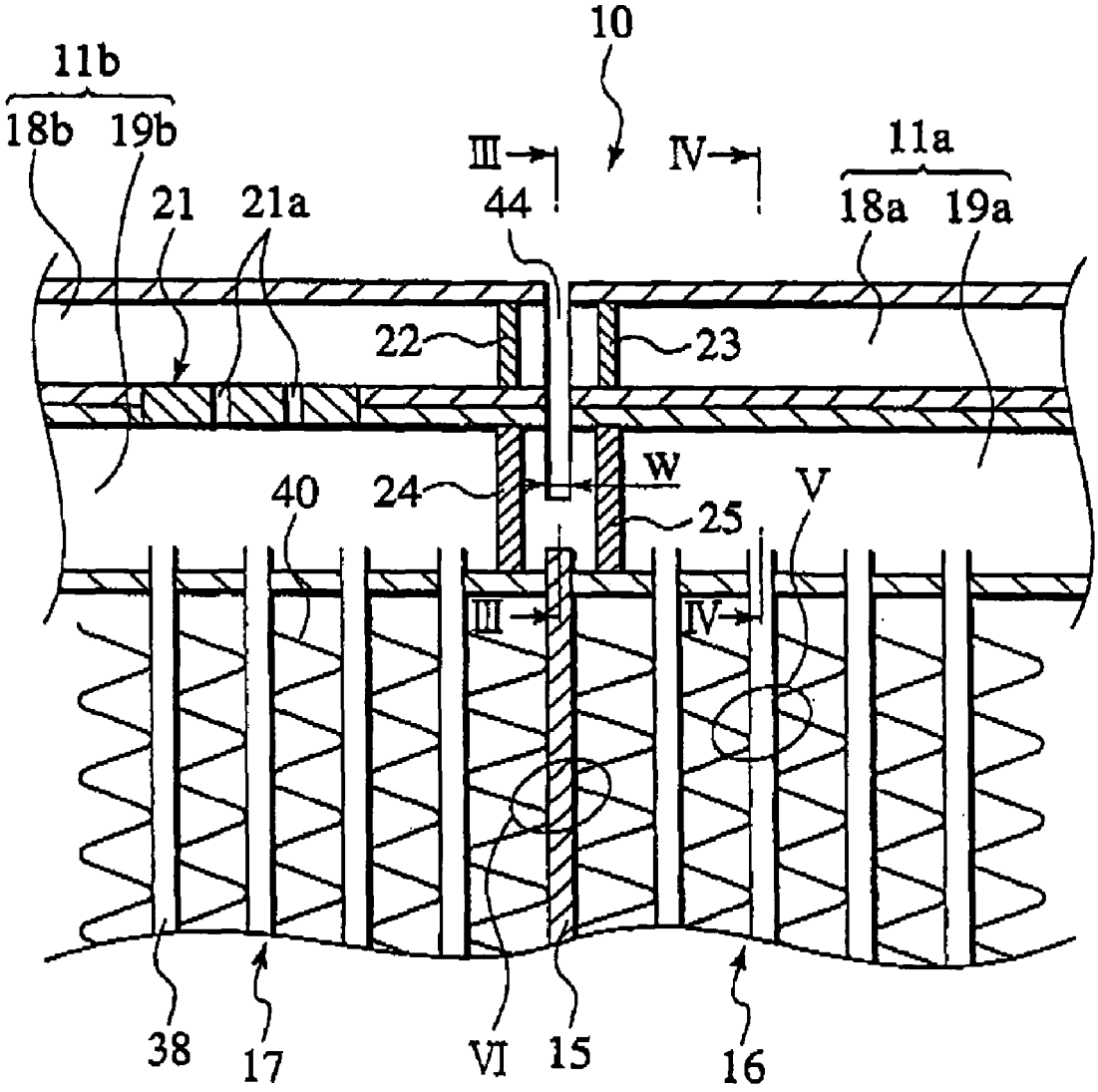
FIG. 2 is an enlarged sectional view taken along a portion II in FIG. 1.

FIG. 2 is an enlarged sectional view of a portion II in FIG. 1. The upper pipe 18 and the lower pipe 19 constituting the upper header pipe 11 are provided with panel walls 22 to 25. The pseudo heat exchanging passage member 15 is disposed below a substantially central position between the left and right panel walls. The pseudo heat exchanging passage member 15 is a solid member and disposed at a boundary between the capacitor section 17 and the oil cooler section 16. As shown in FIG. 2, the upper pipe 18 and the lower pipe 19 are formed with the panel walls 22 and 23, and the panel walls 24 and 25, respectively.

Figure 3:
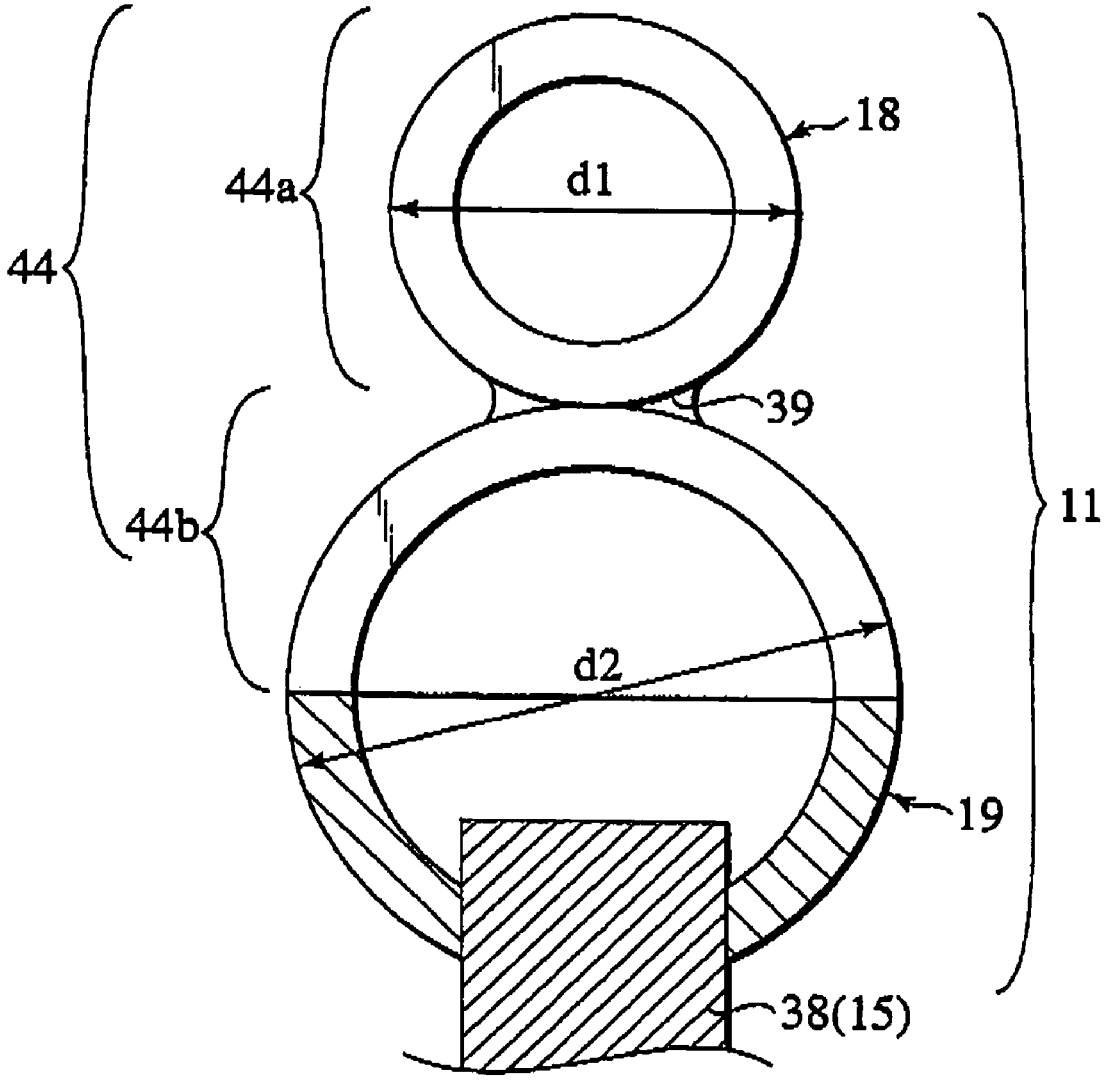
FIG. 3 is an enlarged sectional view taken along a portion III in FIG. 2.
Figure 4:
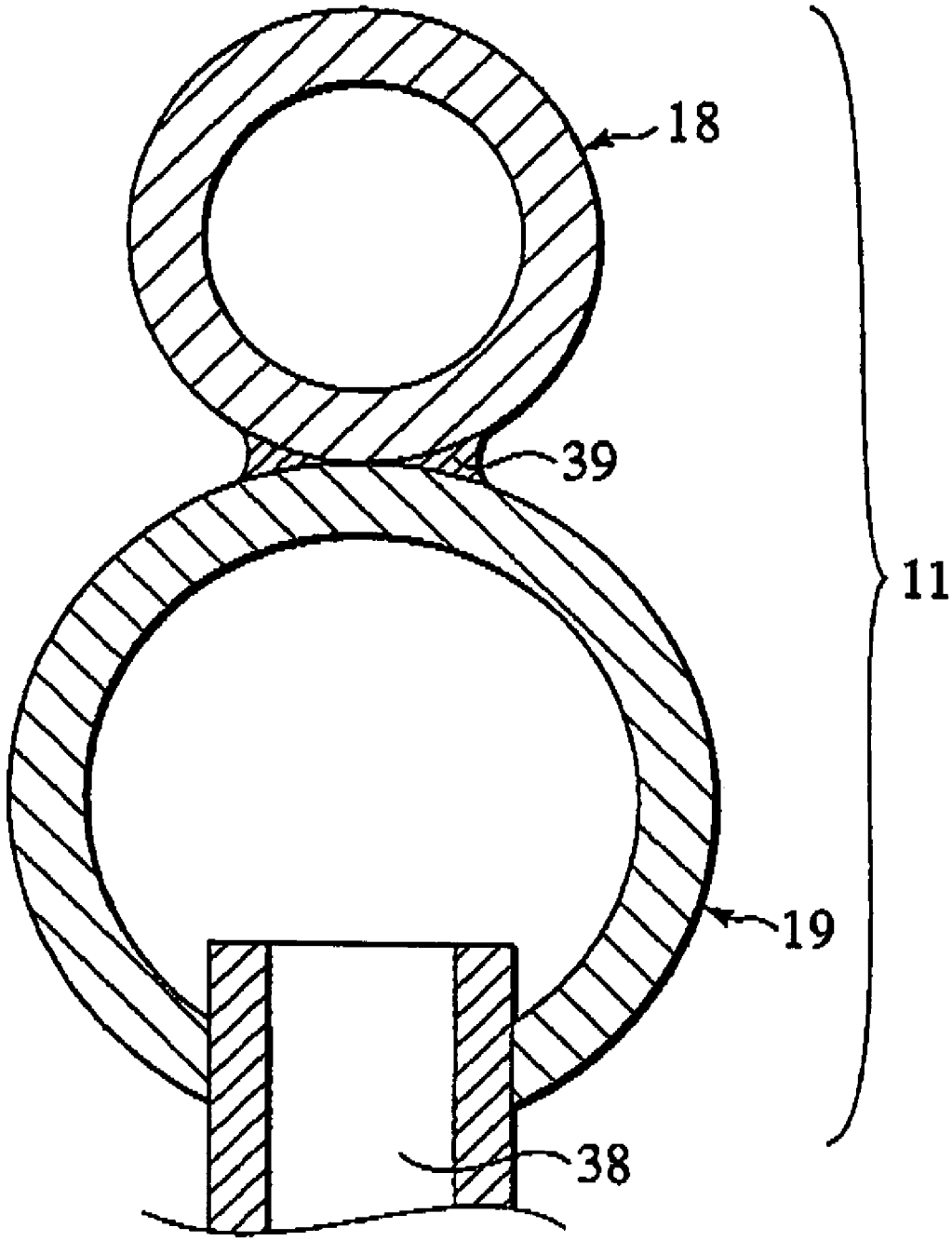
FIG. 4 is an enlarged sectional view taken along a portion IV in FIG. 2.

As shown in FIG. 3, the upper pipe 18 is completely divided laterally by the notch 44*a* into two pieces from its portion corresponding to a space between the panel walls 22 and 23. A portion of the lower pipe 19 corresponding to a space between the panel walls 24 and 25 is formed with a notch 44*b*. That is, the portion of the lower pipe 19 from its upper end to its central portion in its radial direction is formed with the notch 44*b*. These notches 44*a* and 44*b* constitute the notch 44. As a result, the upper header pipe 11 is divided into an L-side upper header pipe 11*a* having an upper pipe 18*a* and a lower pipe 19*a* included in the oil cooler section, and an R-side upper header pipe 11*b* having an upper pipe 18*b* and a lower pipe 19*b* included in the capacitor section. The notch 44 mechanically functions as a connecting member between the oil cooler section and the capacitor section.

The upper pipe 18 and the lower pipe 19 are bonded to each other through a brazed clad layer 39. The upper pipe 18 has a diameter d1, and the lower pipe 19 has a diameter d2. The diameter d1 is smaller than the diameter d2. A lower half of the lower pipe 19 having the greater diameter is not cut and the notch 44 is formed. Therefore, even if the upper pipe 18 is completely divided by the notch 44*a*, since the upper pipe 18 and the lower pipe 19 are bonded to each other, the connection strength between the oil cooler section 16 and the capacitor section 17 is maintained strongly.

The openings of the upper pipe 18 are occluded by the two disk panel walls 22 and 23 being provided in the intermediate portions thereof in its longitudinal direction. The lower pipe 19 is also provided with the panel walls 24 to 26 at locations corresponding to the panel walls 22 and 23 of the upper pipe 18 and on the side of the liquid tank 14. The joint members 20 and 21 are disposed between the panel walls 24 and 26. Like the upper header pipe 11, the lower header pipe 12 also comprises an upper pipe 27 and a lower pipe 28 adjacent to each other, joint members 29 to 31 to bring the upper pipe 27 and the lower pipe 28 into communication with each other, and panel walls 32 to 37. In the core sections 13, a plurality of heat exchanging tubes 38 are vertically arranged side-by-side, through which heat exchanging medium flows. Corrugated fins (see FIG. 2) are disposed between the adjacent heat exchanging tubes 38.

Figure 5:
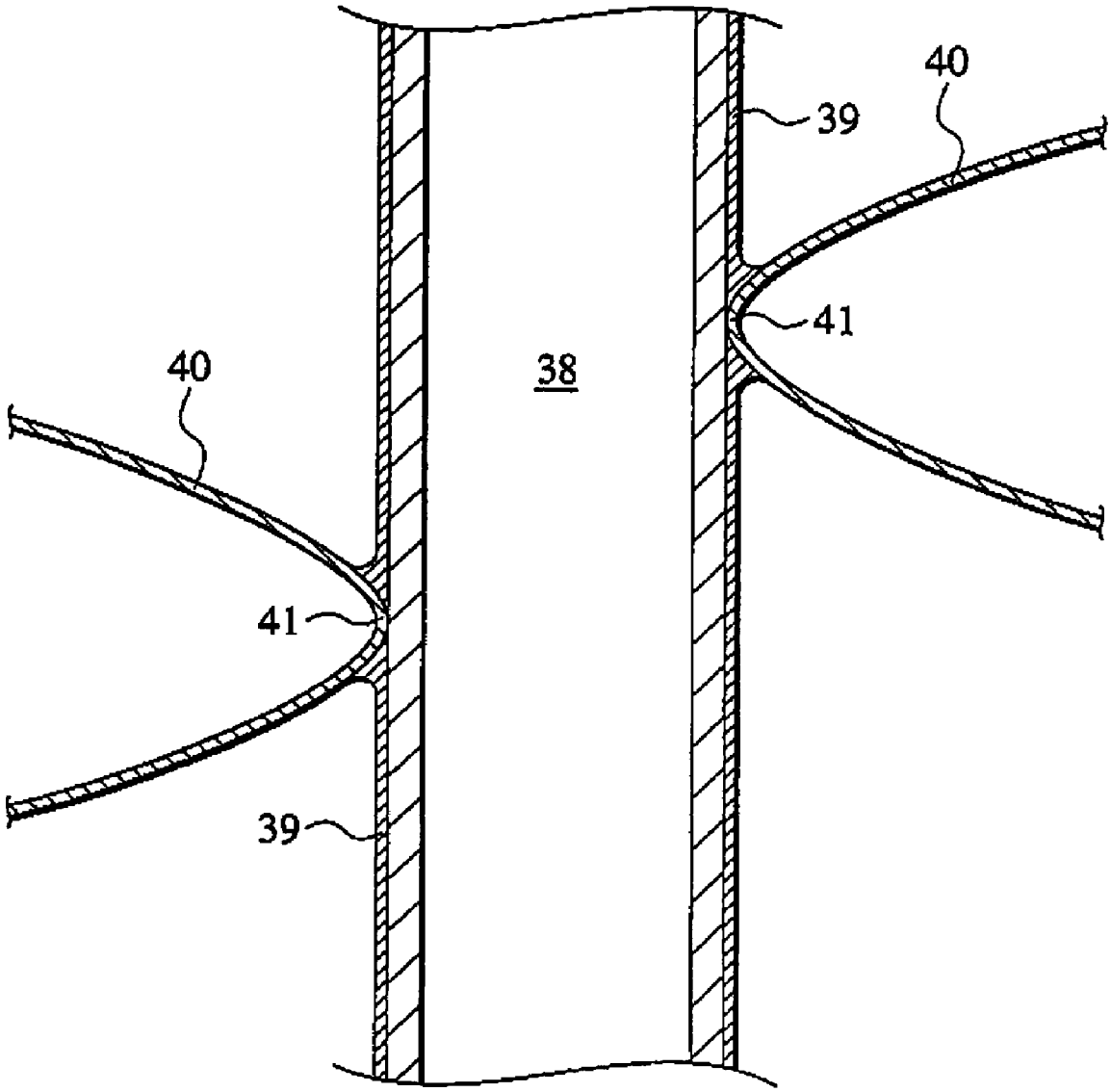
FIG. 5 is an enlarged sectional view taken along a portion V in FIG. 2.

As shown in FIG. 5, a clad layer 39 made of brazing material is formed on an outer surface of the hollow heat exchanging tube 38. The fins 40 are bonded to the heat exchanging tube 38 through the clad layer 39. That is, the clad layer 39 made of brazing material (i.e., aluminum alloy material) is formed on the outer surface of the heat exchanging tube 38. An apex 41 of the fin 40 abuts against the clad layer 39 and in this state, the entire heat exchanger is heated so that only the clad layer 39 is melted and the fin 40 is brazed to the heat exchanging tube 38.

Figure 6:
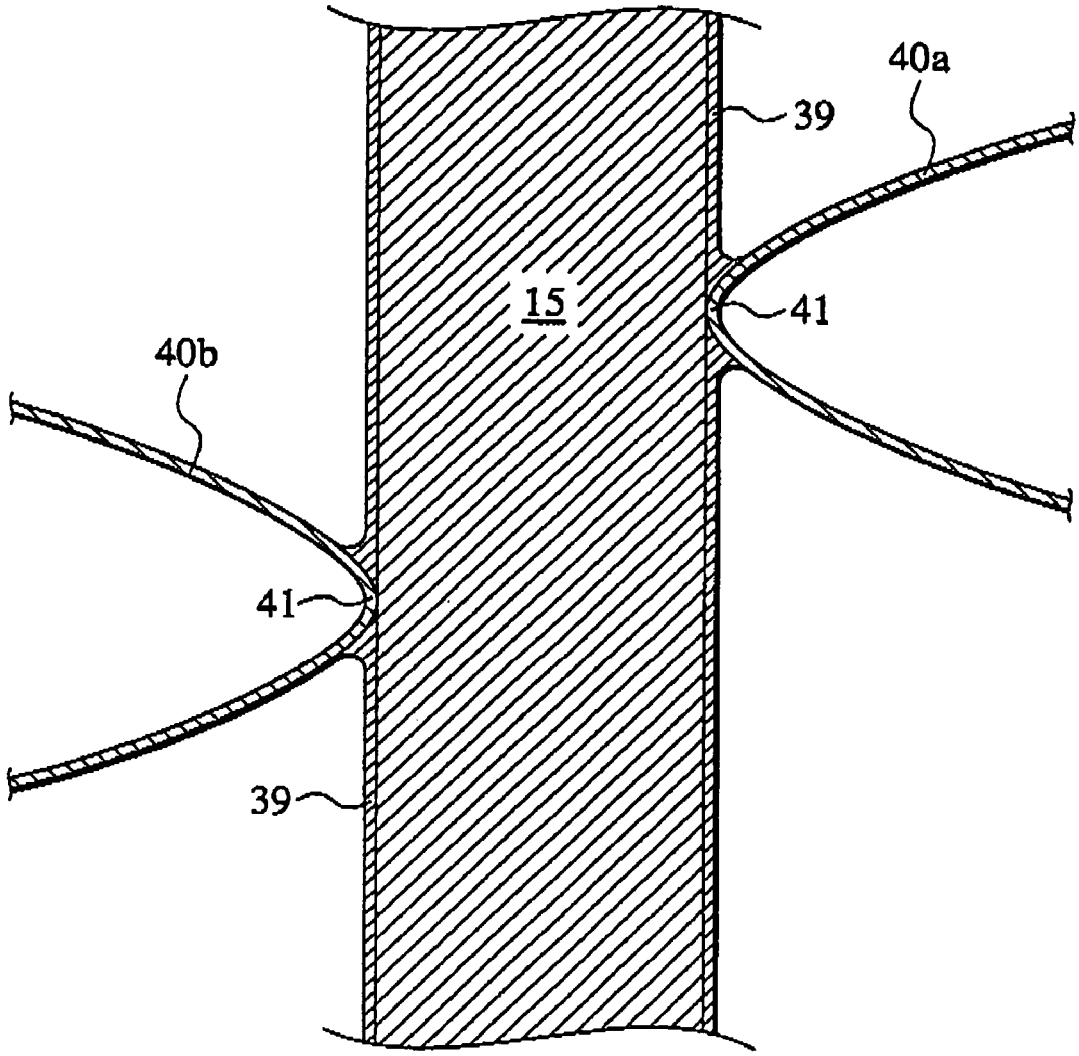
FIG. 6 is an enlarged sectional view taken along an VI portion in FIG. 2.

As shown in FIG. 6 in which a portion VI in FIG. 2 is enlarged, adjacent fins 40*b* and 40*a* on the left and right opposite sides of the pseudo heat exchanging passage member 15 are also bonded to the pseudo heat exchanging passage member 15 through a clad layer 39 made of brazing material.

A flow passage for a medium 42 as a first heat exchanging medium and a flow passage for oil 43 as a second heat exchanging medium in the heat exchanger 10 of the first embodiment will be explained using FIG. 7. To clearly show the flow of the medium 42 and the like, the fins 40 are omitted in FIG. 7.

Figure 7:
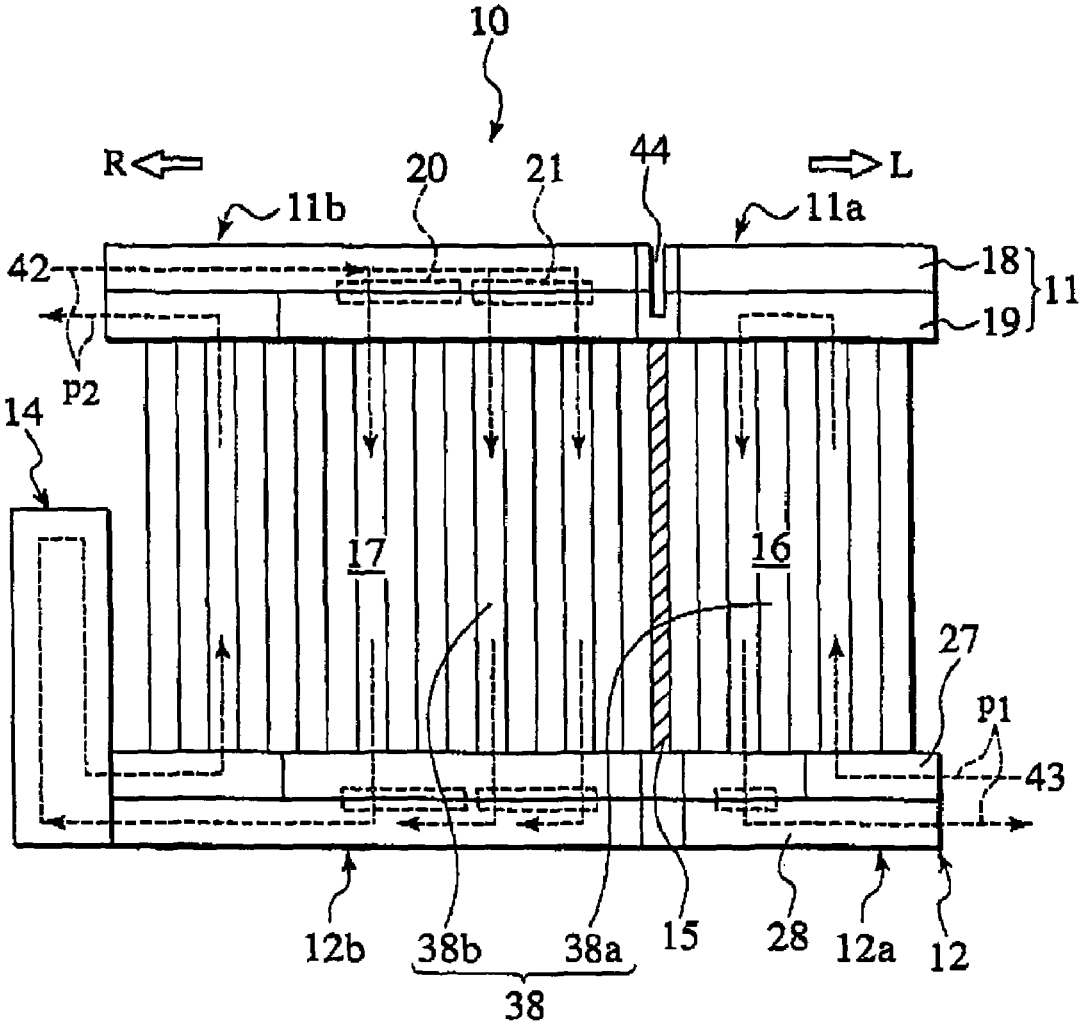
FIG. 7 is a schematic diagram showing a medium in a heat exchanger and a flow passage for oil according to the first embodiment.

As shown in FIG. 7, the R-side capacitor section 17 includes a flow passage p2. In the flow passage p2, the medium 42 which flowed into the upper pipe 18*b* of the upper header pipe 11*b* downwardly flows in a heat exchanging tube 38*b* from the joint members 20 and 21 through the lower pipe 19 and then, the medium 42 flows upward in the heat exchanging tube 38*b* from the lower header pipe 12*b* through the liquid tank 14.

The L-side oil cooler section 16 includes a flow passage p1. In the flow passage p1, oil 43 which flowed from the upper pipe 27*a* of the lower header pipe 12*a* flows upward through the heat exchanging tube 38*a* and turns down in the lower pipe 19*a* of the upper header pipe 11*a* and flows downward through the heat exchanging tube 38*a* and then is returned into the transmission from the lower pipe 28*a* of the lower header pipe 12*a*. The temperature of the medium 42 flowing through the capacitor section 17 is about 60° C., but the temperature of the oil 43 flowing through the oil cooler section 16 is as extremely high as about 110° C., and the temperature difference is large.

In the heat exchanger 10 of the first embodiment, the dimensional change caused by thermal expansion in the core section 13*a* of the oil cooler section 16 is greater than the dimensional change caused by thermal expansion in the core section 13*b* of the capacitor section 17, but since the notch 44 is provided from an upper portion to a portion of the upper header pipe 11 in the vertical direction, the difference between dimensional changes can sufficiently be absorbed by the notch 44, and the deformation of the header pipe can be suppressed. Since the lower half of the lower pipe 19 having the larger diameter is not cut off, the connection strength between the oil cooler section 16 and the capacitor section 17 can be maintained at high level. Therefore, since the notch 44 is provided, it is possible to absorb the stress generated by the dimensional change caused by difference in thermal expansion amount, and it is possible to strengthen the supporting strength of the heat exchanger 10. Although the flow passages p1 and p2 as shown in FIG. 7 are provided in this embodiment, the invention is not limited to this, and any flow passages can be used depending upon disposition of the panel walls in the upper header pipe 11, the core section 13, and the lower header pipe 13.

Second Embodiment

A heat exchanger 47 of a second embodiment will be explained. The same members as those of the heat exchanger 10 of the first embodiment are designated with the same symbols, and explanation thereof is omitted.

Figure 8:
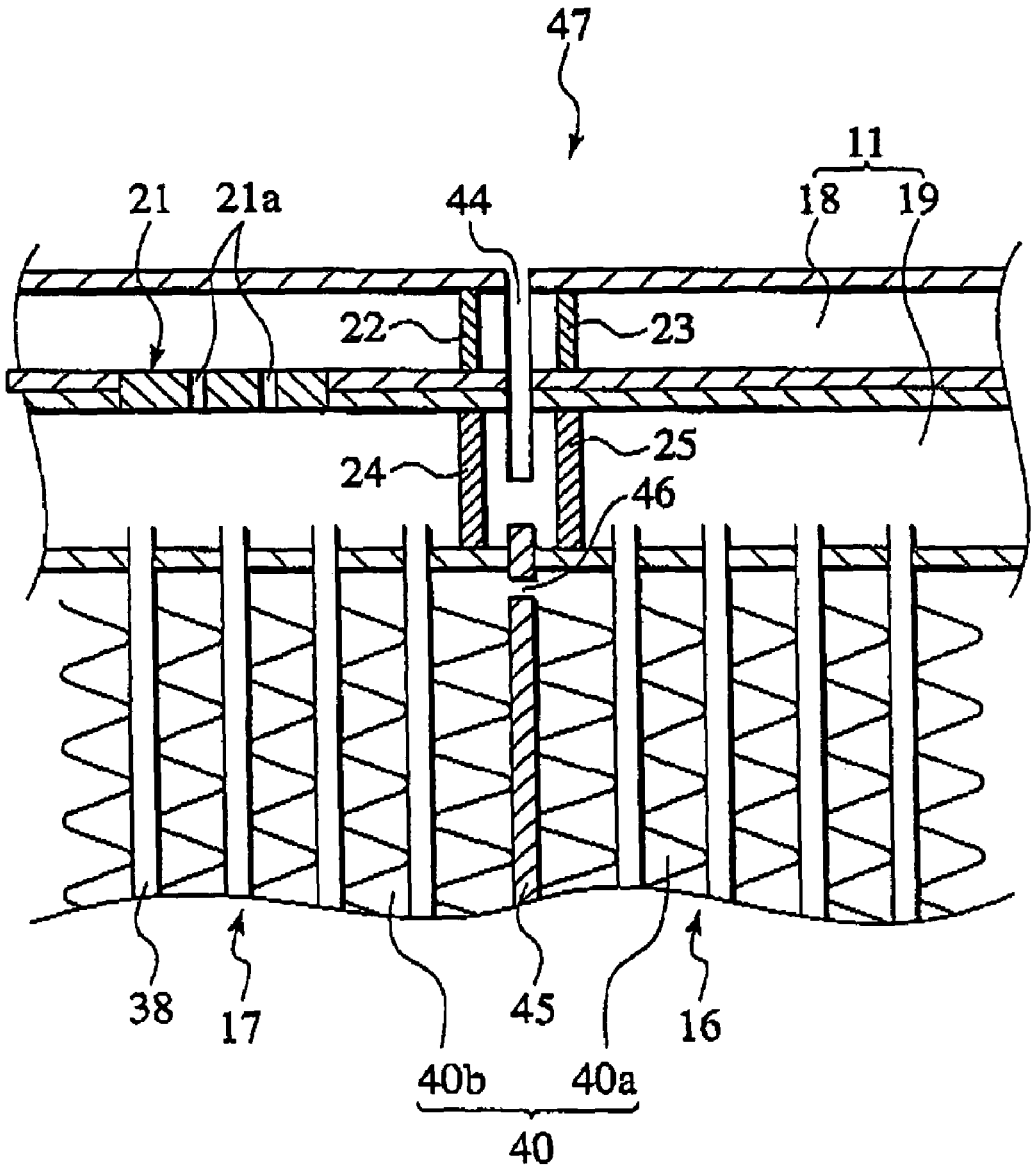
FIG. 8 is a sectional view showing an essential portion of a heat exchanger according to a second embodiment of the present invention.

In the second embodiment, as shown in FIG. 8, the upper header pipe 11 is formed with the notch 44. A portion of the pseudo heat exchanging passage member 45 being close to the connection portion to the upper header pipe 11 is provided with a cut-portion 46, which separates the pseudo heat exchanging passage member 45 and the upper header pipe 11 from each other. The cut-portion 46 can be formed by integrally brazing the entire heat exchanger 47 and then cutting an upper end of the pseudo heat exchanging passage member 45. As a result, the pseudo heat exchanging passage member 45 as a connecting member is mechanically separated from the upper header pipe 11.

According to the heat exchanger 47 of this embodiment, when the dimensional change caused by thermal expansion is generated between the oil cooler section 16 and the capacitor section 17, the dimensional change can be absorbed more efficiently. Therefore, the deformation of the header pipe can further be suppressed.

The present invention is not limited to the first or second embodiment, and can be variously changed and modified. For example, only the upper header pipe 11 is provided with the notch 44 in the embodiment, but the lower header pipe 12 may be provided with the notch. Although the upper end of the pseudo heat exchanging passage member 45 is cut in the second embodiment, the lower end thereof may be cut instead.

This application claims benefit of priority under 35USC §119 to Japanese Patent Applications No. 2003-135894, filed on May 14, 2003, the entire contents of which are incorporated by reference herein.

What is claimed is:

1. A multi-function heat exchanger, comprising:

a first core section having a plurality of first heat exchanging tubes and first fins being mounted between the first heat exchanging tubes;

a second core section having a plurality of second heat exchanging tubes and second fins being mounted between the second heat exchanging tubes;

a connecting member connecting the first core section and the second core section with each other;

a first header pipe being connected to first ends of the first heat exchanging tubes and first ends of the second heat exchanging tubes, the first header pipe having panel walls to divide a space therein;

a second header pipe being connected to second ends of the first heat exchanging tubes and second ends of the second heat exchanging tubes and;

a notch formed between the panel walls of the first header pipe, wherein a portion of the notch is cut off in a radial direction of the first header pipe, wherein a first heat exchanger section includes a flow passage through the first header pipe, the first heat exchanging tubes, and the second header pipe; and wherein a second heat exchanger section includes a flow passage through the first header pipe, the second heat exchanging tube, and the second header pipe, and the flow passage of the second heat exchanger section is separated from the flow passage of the first heat exchanger section.

2. The multi-function heat exchanger according to claim 1, wherein the second header pipe has panel walls to divide a space therein.

3. The multi-function heat exchanger according to claim 1, wherein the connecting member is a pseudo heat exchanging tube.

4. The multi-function heat exchanger according to claim 1, wherein the connecting member is separated from the first header pipe.

5. The multi-function heat exchanger according to claim 1, wherein the connecting member is separated from the first header pipe and from the second header pipe.

* * * * *